US007846308B2

(12) United States Patent
De Nora et al.

(10) Patent No.: US 7,846,308 B2
(45) **Date of Patent: *Dec. 7, 2010**

(54) NON-CARBON ANODES

(75) Inventors: Vittorio De Nora, Veyras (CH); Thinh T. Nguyen, Onex (CH)

(73) Assignee: Riotinto Alcan International Limited, Montreal (CA)

( * ) Notice: Subject to any disclaimer, the term of this patent is extended or adjusted under 35 U.S.C. 154(b) by 192 days.

This patent is subject to a terminal disclaimer.

(21) Appl. No.: 10/591,634

(22) PCT Filed: Mar. 18, 2005

(86) PCT No.: PCT/IB2005/000797

§ 371 (c)(1),
(2), (4) Date: Sep. 5, 2006

(87) PCT Pub. No.: WO2005/090643

PCT Pub. Date: Sep. 29, 2005

(65) Prior Publication Data

US 2007/0144617 A1 Jun. 28, 2007

(30) Foreign Application Priority Data

Mar. 18, 2004 (WO) ..... PCT/IB2004/000886
Apr. 29, 2004 (WO) ..... PCT/IB2004/001416

(51) Int. Cl.
*C25C 3/06* (2006.01)
*C25C 3/08* (2006.01)
*C25C 3/12* (2006.01)

(52) U.S. Cl. ..... 204/243.1; 204/247.3; 204/280; 204/290.01; 204/290.03; 204/290.12; 205/372; 205/384; 205/385; 205/387; 205/394

(58) Field of Classification Search ..... 204/280, 204/290.01, 290.03, 290.12, 243.1, 247.3; 205/372, 384, 385, 387, 394
See application file for complete search history.

(56) References Cited

U.S. PATENT DOCUMENTS 5,248,510 A * 9/1993 Lim et al. ..... 429/236
5,954,928 A * 9/1999 Kishi et al. ..... 204/290.08
2007/0193878 A1 * 8/2007 Nguyen et al. ..... 204/243.1

* cited by examiner

*Primary Examiner*—Bruce F Bell

(57) ABSTRACT

An anode for electrowinning of aluminium from alumina comprises a cobalt-containing metallic outer part that is covered with an integral oxide layer containing predominantly cobalt oxide CoO. The integral oxide layer can be formed by surface oxidation of cobalt from the metallic outer part before use.

27 Claims, No Drawings

NON-CARBON ANODES

FIELD OF THE INVENTION

This invention relates to a metal-based anode for aluminium electrowinning, a method for manufacturing such an anode, a cell fitted with this anode, and a method of electrowinning aluminium in such a cell.

BACKGROUND ART

Using non-carbon anodes—i.e. anodes which are not made of carbon as such, e.g. graphite, coke, etc. . . . , but possibly contain carbon in a compound or in a marginal amount—for the electrowinning of aluminium should drastically improve the aluminium production process by reducing pollution and the cost of aluminium production. Many attempts have been made to use oxide anodes, cermet anodes and metal-based anodes for aluminium production, however they were never adopted by the aluminium industry.

For the dissolution of the raw material, usually alumina, a highly aggressive fluoride-based electrolyte at a temperature between 900° and 1000° C., such as molten cryolite, is required.

Therefore, anodes used for aluminium electrowinning should be resistant to oxidation by anodically evolved oxygen and to corrosion by the molten fluoride-based electrolyte.

The materials having the greatest resistance under such conditions are metal oxides which are all to some extent soluble in cryolite. Oxides are also poorly electrically conductive, therefore, to avoid substantial ohmic losses and high cell voltages, the use of non-conductive or poorly conductive oxides should be minimal in the manufacture of anodes. Whenever possible, a good conductive material should be utilised for the anode core, whereas the surface of the anode is preferably made of an oxide having a high electrocatalytic activity for the oxidation of oxygen ions.

Several patents disclose the use of an electrically conductive metal anode core with an oxide-based active outer part, in particular U.S. Pat. Nos. 4,956,069, 4,960,494, 5,069,771 (all Nguyen/Lazouni/Doan), U.S. Pat. No. 6,077,415 (Duruz/de Nora), U.S. Pat. No. 6,103,090 (de Nora), U.S. Pat. No. 6,113,758 (de Nora/Duruz) and U.S. Pat. No. 6,248,227 (de Nora/Duruz), U.S. Pat. No. 6,361,681 (de Nora/Duruz), U.S. Pat. No. 6,365,018 (de Nora), U.S. Pat. No. 6,372,099 (Duruz/de Nora), U.S. Pat. No. 6,379,526 (Duruz/de Nora), U.S. Pat. No. 6,413,406 (de Nora), U.S. Pat. No. 6,425,992 (de Nora), U.S. Pat. No. 6,436,274 (de Nora/Duruz), U.S. Pat. No. 6,521,116 (Duruz/de Nora/Crottaz), U.S. Pat. No. 6,521,115 (Duruz/de Nora/Crottaz), U.S. Pat. No. 6,533,909 (Duruz/de Nora), U.S. Pat. No. 6,562,224 (Crottaz/Duruz) as well as PCT publications WO00/40783 (de Nora/Duruz), WO01/42534 (de Nora/Duruz), WO01/42535 (Duruz/de Nora), WO01/42536 (Nguyen/Duruz/de Nora), WO02/070786 (Nguyen/de Nora), WO02/083990 (de Nora/Nguyen), WO02/083991 (Nguyen/de Nora), WO03/014420 (Nguyen/Duruz/de Nora), WO03/078695 (Nguyen/de Nora), WO03/087435 (Nguyen/de Nora).

U.S. Pat. No. 4,374,050 (Ray) discloses numerous multiple oxide compositions for electrodes. Such compositions inter-alia include oxides of iron and cobalt. The oxide compositions can be used as a cladding on a metal layer of nickel, nickel-chromium, steel, copper, cobalt or molybdenum.

U.S. Pat. No. 4,142,005 (Cadwell/Hazelrigg) discloses an anode having a substrate made of titanium, tantalum, tungsten, zirconium, molybdenum, niobium, hafnium or vanadium. The substrate is coated with cobalt oxide $Co_3O_4$.

U.S. Pat. No. 6,103,090 (de Nora), U.S. Pat. No. 6,361,681 (de Nora/Duruz), U.S. Pat. No. 6,365,018 (de Nora), U.S. Pat. No. 6,379,526 (de Nora/Duruz), U.S. Pat. No. 6,413,406 (de Nora) and U.S. Pat. No. 6,425,992 (de Nora), and WO04/018731 (Nguyen/de Nora) disclose anode substrates that contain at least one of chromium, cobalt, hafnium, iron, molybdenum, nickel, copper, niobium, platinum, silicon, tantalum, titanium, tungsten, vanadium, yttrium and zirconium and that are coated with at least one ferrite of cobalt, copper, chromium, manganese, nickel and zinc. WO01/42535 (Duruz/de Nora) and WO02/097167 (Nguyen/de Nora), disclose aluminium electrowinning anodes made of surface oxidised iron alloys that contain at least one of nickel and cobalt. U.S. Pat. No. 6,638,412 (de Nora/Duruz) discloses the use of anodes made of a transition metal-containing alloy having an integral oxide layer, the alloy comprising at least one of iron, nickel and cobalt.

These non-carbon anodes have not as yet been commercially and industrially applied and there is still a need for a metal-based anodic material for aluminium production.

SUMMARY OF THE INVENTION

The present invention relates to an anode for electrowinning aluminium from alumina dissolved in a molten electrolyte. The anode comprises a cobalt-containing metallic outer part that is covered with an integral oxide layer containing predominantly cobalt oxide CoO. The integral oxide layer can be formed by surface oxidation of the metallic outer part under special conditions as outlined below.

The oxidation of cobalt metal can lead to different forms of stoichiometric and non-stoichiometric cobalt oxides which are based on:

CoO that contains Co(II) and that is formed predominantly at a temperature above 920° C. in air;

$Co_2O_3$ that contains Co(III) and that is formed at temperatures up to 895° C. and at higher temperatures begins to decompose into CoO;

$Co_3O_4$ that contains Co(II) and Co(III) and that is formed at temperatures between 300 and 900° C.

It has been observed that, unlike $Co_2O_3$ that is unstable and $Co_3O_4$ that does not significantly inhibit oxygen diffusion, CoO formed by oxidation of a cobalt body forms a well conductive electrochemically active material for the oxidation of oxygen ions and inhibits diffusion of oxygen, thus forms a limited barrier against oxidation of the metallic cobalt body underneath.

When CoO is to be formed by oxidising metallic cobalt, care should be taken to carry out a treatment that will indeed result in the formation of CoO. It was found that using $Co_2O_3$ or $Co_3O_4$ in a known aluminium electrowinning electrolyte does not lead to an appropriate conversion of these forms of cobalt oxide into CoO. Therefore, it is important to provide an anode with a CoO integral layer already before use in an aluminium electrowinning electrolyte.

The formation of CoO on the metallic cobalt is preferably controlled so as to produce a coherent and substantially crack-free oxide layer.

Even if CoO offers better electrochemical properties than a $Co_2O_3/Co_3O_4$, not any treatment of metallic cobalt at a temperature above 895° C. or 900° C. in an oxygen-containing atmosphere will result in the production of an optimal coherent and substantially crack-free CoO layer.

For instance, if the temperature for treating the metallic cobalt to form CoO by air oxidation of metallic cobalt is increased at an insufficient rate, e.g. less than 200° C./hour, a thick oxide layer rich in $Co_3O_4$ and in glassy $Co_2O_3$ is formed at the surface of the metallic cobalt. Such a layer does not permit optimal formation of the CoO layer by conversion at a temperature above 895° C. of $Co_2O_3$ and $Co_3O_4$ into CoO. On the contrary, such a layer resulting from the conversion has an increased porosity and may be cracked. Therefore, the required temperature for air oxidation, i.e. above 900° C., usually at least 920° C. or preferably above 940° C., should be attained sufficiently quickly, e.g. at a rate of increase of the temperature of at least 300° C. or 600° C. per hour to obtain an optimal CoO layer. The metallic cobalt may also be placed into an oven that is pre-heated at the desired temperature above 900° C.

Likewise, if the anode is not immediately used for the electrowinning of aluminium after formation of the CoO layer but allowed to cool down, the cooling down should be carried out sufficiently fast, for example by placing the anode in air at room temperature, to avoid significant formation of $Co_3O_4$ during the cooling, for instance in an oven that is switched off.

However, even an anode with a less than optimal CoO layer obtained by slow heating of the metallic cobalt in an oxidising environment still provides better results during cell operation than an anode having a $Co_2O_3$—$Co_3O_4$ layer and can be used to make an aluminium electrowinning anode according to the invention.

Advantageously, the anode's integral oxide layer has an open porosity of below 12%, in particular below 7%.

The anode's integral oxide layer can have an average pore size below 7 micron, in particular below 4 micron. It is preferred to provide a substantially crack-free integral oxide layer so as to protect efficiently the anode's metallic outer part which is covered by this integral oxide layer.

The metallic outer part may contain: at least one of nickel, tungsten, molybdenum, tantalum and niobium in a total amount of 5 to 30 wt %, in particular 10 to 20 wt %, the nickel, when present, being contained in the metallic outer part in an amount of up to 20 weight %, in particular 5 to 15 weight %; and one or more further elements and compounds in a total amount of up to 5 wt % such as 0.01 to 4 weight %, the balance being cobalt. Such an amount of nickel in the cobalt metallic outer part, leads to the formation of a small amount of nickel oxide NiO in the integral oxide layer, in about the same proportions to cobalt as in the metallic part, i.e. 5 to 15 or 20 weight %. It has been observed that the presence of a small amount of nickel oxide stabilises the cobalt oxide CoO and durably inhibits the formation of $Co_2O_3$ or $Co_3O_4$. However, when the weight ratio nickel/cobalt exceeds 0.15 or 0.2, the advantageous chemical and electrochemical properties of cobalt oxide CoO tend to disappear. Therefore, the nickel content should not exceed this limit.

The metallic outer part may contain cobalt in an amount of at least 95 wt %, in particular more than 97 wt % or 99 wt % cobalt. The metallic outer part can contain a total amount of 0.1 to 2 wt % of at least one additive selected from silicon, manganese, tantalum and aluminium, in particular 0.1 to 1 wt %, which additives can be used for improving casting and/or oxidation resistance of the cobalt.

Usually, the integral oxide layer contains cobalt oxide CoO in an amount of at least 80 wt %, in particular more than 90 wt % or 95 wt %.

Advantageously, the integral oxide layer is substantially free of cobalt oxide $Co_2O_3$ and $Co_3O_4$, and contains preferably below 3 or 1.5% of these forms of cobalt oxide.

The integral oxide layer may be electrochemically active for the oxidation of oxygen ions, in which case the layer is uncovered or is covered with an electrolyte-pervious layer.

Alternatively, the integral oxide layer can be covered with an applied protective layer, in particular an applied oxide layer such as a layer containing cobalt and/or iron oxide, e.g. cobalt ferrite. The protective layer may contain a pre-formed and/or in-situ deposited cerium compound, in particular cerium oxyfluoride, as for example disclosed in the above-mentioned U.S. Pat. Nos. 4,956,069, 4,960,494 and 5,069,771. Such an applied protective layer is usually electrochemically active for the oxidation of oxygen ions and is uncovered, or covered in turn with an electrolyte pervious-layer.

The anode's electrochemically active surface can contain at least one dopant, in particular at least one dopant selected from iridium, palladium, platinum, rhodium, ruthenium, silicon, tantalum, tin or zinc metals, Mischmetal and their oxides, and metals of the Lanthanide series, as well as mixtures and compounds thereof, in particular oxides. The active anode surface may contain a total amount of 0.1 to 5 wt % of the dopant(s), in particular 1 to 4 wt % or 1.5 to 2.5%.

Such a dopant can be an electrocatalyst for fostering the oxidation of oxygen ions on the anode's electrochemically active surface and/or can contribute to inhibit diffusion of oxygen ions into the anode.

When the anode has an applied electrochemically active layer, the dopant may be added to the precursor material that is applied to form the active layer on the oxidised metallic cobalt. When the integral CoO layer is electrochemically active, the dopant can be alloyed to the metallic cobalt outer part or it can be applied to the metallic cobalt as a thin film, for example by plasma spraying or slurry application, and be subjected to the oxidation treatment that forms the integral oxide layer and combine with the CoO.

The invention also relates to a method of manufacturing an anode as described above. The method comprises: providing an anode body having a cobalt-containing metallic outer part; and subjecting the outer part to an oxidation treatment under conditions for forming an integral oxide layer containing predominantly cobalt oxide CoO on the outer part.

Conveniently, the oxidation treatment can be carried out in an oxygen containing atmosphere, such as air. The treatment can also be carried out in an atmosphere that is oxygen rich or predominant or consists essentially of pure oxygen.

It is also contemplated to carry out this oxidation treatment by other means, for instance electrolytically. However, it was found that full formation of the CoO integral layer cannot be achieved in-situ during aluminium electrowinning under normal cell operating conditions. In other words, when the anode is intended for use in a non-carbon anode aluminium electrowinning cell operating under the usual conditions, the anode should always be placed into the cell with a preformed integral oxide layer containing predominantly CoO.

As the conversion of Co(III) into Co(II) occurs at a temperature of about 895° C., the oxidation treatment should be carried out above this temperature. Usually, the oxidation treatment is carried out at an oxidation temperature above 895° C. or 920° C., preferably above 940° C., in particular within the range of 950 to 1050° C. The anode's metallic outer part can be heated from room temperature to this oxidation temperature at a rate of at least 300° C./hour, in particular at least 450° C./hour, or is placed in an environment, in particular in an oven, that is preheated at this oxidation temperature. The oxidation treatment at this oxidation temperature can be carried out for more than 8 or 12 hours, in particular from 16 to 48 hours. Especially when the oxygen-content of the oxidising atmosphere is increased, the duration of the treatment can be reduced below 8 hours, for example down to 4 hours.

The metallic cobalt outer part can be further oxidised during use. However, the main formation of CoO should be achieved before use and in a controlled manner for the reasons explained above.

A further aspect of the invention relates to a cell for the electrowinning of aluminium from alumina dissolved in a molten electrolyte, in particular a fluoride-containing electrolyte. This cell comprises an anode as described above.

The anode may be in contact with the cell's molten electrolyte which is at a temperature below 950° C. or 960° C., in particular in the range from 910° to 940° C.

Another aspect of the invention relates to a method of electrowinning aluminium in a cell as described above. The method comprises passing an electrolysis current via the anode through the electrolyte to produce oxygen on the anode and aluminium cathodically by electrolysing the dissolved alumina contained in the electrolyte.

Oxygen ions may be oxidised on the anode's integral oxide layer that contains predominantly cobalt oxide CoO and/or, when present, on an active layer applied to the anode's integral oxide layer, the integral oxide layer inhibiting oxidation and/or corrosion of the anode's metallic outer part.

Yet in another aspect of the invention, the oxidised metallic cobalt having an integral oxide layer containing predominantly CoO as described above can be used to make the surface of other cell components, in particular anode stems for suspending the anodes, cell sidewalls or cell covers. CoO is particularly useful to protect oxidation or corrosion resistant surfaces.

The invention will be further described in the following examples:

COMPARATIVE EXAMPLE 1

A cylindrical metallic cobalt sample was oxidised to form an integral cobalt oxide layer that did not predominantly contain CoO. The cobalt samples contained no more than a total of 1 wt % additives and impurities and had a diameter of 1.94 cm and a height of 3 cm.

Oxidation was carried out by placing the cobalt sample into an oven in air and increasing the temperature from room temperature to 850° C. at a rate of 120° C./hour.

After 24 hours at 850° C., the oxidised cobalt sample was allowed to cool down to room temperature and examined.

The cobalt sample was covered with a greyish oxide scale having a thickness of about 300 micron. This oxide scale was made of: a 80 micron thick inner layer that had a porosity of 5% with pores that had a size of 2-5 micron; and a 220 micron thick outer layer having an open porosity of 20% with pores that had a size of 10-20 micron. The outer oxide layer was made of a mixture of essentially $Co_2O_3$ and $Co_3O_4$. The denser inner oxide layer was made of CoO.

As shown in Comparative Examples 2 and 3, such oxidised cobalt provides poor results when used as an anode material in an aluminium electrowinning cell.

EXAMPLE 1a

A cobalt sample was prepared as in Comparative Example 1 except that the sample was oxidised in an oven heated from room temperature to a temperature of 950° C. (instead of 850° C.) at the same rate (120° C./hour).

After 24 hours at 950° C., the oxidised cobalt sample was allowed to cool down to room temperature and examined.

The cobalt sample was covered with a black glassy oxide scale having a thickness of about 350 micron (instead of 300 micron). This oxide scale had a continuous structure (instead of a layered structure) with an open porosity of 10% (instead of 20%) and pores that had a size of 5 micron. The outer oxide layer was made of CoO produced above 895° C. from the conversion into CoO of $Co_3O_4$ and glassy $Co_2O_3$ formed below this temperature and by oxidising the metallic outer part of the sample (underneath the cobalt oxide) directly into CoO. The porosity was due to the change of phase during the conversion of $Co_2O_3$ and $Co_3O_4$ to CoO.

Such a material can be used to produce an aluminium electrowinning anode according to the invention. However, the density of the CoO layer and the performances of the anode can be further improved as shown in Examples 1c and 1d.

In general, to allow appropriate conversion of the cobalt oxide and growth of CoO from the metallic outer part of the substrate, it is important to leave the sample sufficiently long at a temperature above 895° C. The length of the heat treatment will depend on the oxygen content of the oxidising atmosphere, the temperature of the heat treatment, the desired amount of CoO and the amount of $Co_2O_3$ and $Co_3O_4$ to convert into CoO.

EXAMPLE 1b

Example 1a was repeated with a similar cylindrical metallic cobalt samples. The oven in which the sample was oxidised was heated to a temperature of 1050° C. (instead of 950° C.) at the same rate (120° C./hour).

After 24 hours at 1050° C., the oxidised cobalt sample was allowed to cool down to room temperature and examined.

The cobalt sample was covered with a black crystallised oxide scale having a thickness of about 400 micron (instead of 350 micron). This oxide scale had a continuous structure with an open porosity of 20% (instead of 10%) and pores that had a size of 5 micron. The outer oxide layer was made of CoO produced above 895° C. like in Example 1a.

Such a oxidised cobalt is comparable to the oxidised cobalt of Example 1a and can likewise be used as an anode material to produce aluminium.

In general, to allow appropriate conversion of the cobalt oxide and growth of CoO from the metallic outer part of the substrate, it is important to leave the sample sufficiently long at a temperature above 895° C. The length of the heat treatment above 895° C. will depend on the oxygen content of the oxidising atmosphere, the temperature of the heat treatment, the desired amount of CoO and the amount of $Co_2O_3$ and $Co_3O_4$ (produced below 895° C.) which needs to be converted into CoO.

EXAMPLE 1c

Improved Material

Example 1a was repeated with a similar cylindrical metallic cobalt samples. The oven in which the sample was oxidised was heated to the same temperature (950° C.) at a rate of 360° C./hour (instead of 120° C./hour).

After 24 hours at 950° C., the oxidised cobalt sample was allowed to cool down to room temperature and examined.

The cobalt sample was covered with a dark grey substantially non-glassy oxide scale having a thickness of about 350 micron. This oxide scale had a continuous structure with an open porosity of less than 5% (instead of 10%) and pores that had a size of 5 micron.

The outer oxide layer was made of CoO that was formed directly from metallic cobalt above 895° C. which was reached after about 2.5 hours and to a limited extent from the conversion of previously formed $Co_2O_3$ and $Co_3O_4$. It followed that there was less porosity caused by the conversion of $Co_2O_3$ and $Co_3O_4$ to CoO than in Example 1a.

Such an oxidised cobalt sample has a significantly higher density than the samples of Examples 1a and 1b, and is substantially crack-free. This oxidised cobalt constitutes a preferred material for making an improved aluminium electrowinning anode according to the invention.

EXAMPLE 1d

Improved Material

Example 1c was repeated with a similar cylindrical metallic cobalt samples. The oven in which the sample was oxidised was heated to the same temperature (1050° C.) at a rate of 600° C./hour (instead of 120° C./hour in Example 1a and 1b and 360° C./hour in Example 1c).

After 18 hours at 1050° C., the oxidised cobalt sample was allowed to cool down to room temperature and examined.

The cobalt sample was covered with a dark grey substantially non-glassy oxide scale having a thickness of about 300 micron (instead of 400 micron in Example 1b and 350 micron in Example 1c). This oxide scale had a continuous structure with a crack-free open porosity of less than 5% (instead of 20% in Example 1b) and pores that had a size of less than 2 micron (instead of 5 micron in Example 1b and in Example 1c).

The outer oxide layer was made of CoO that was formed directly from metallic cobalt above 895° C. which was reached after about 1.5 hours and to a marginal extent from the conversion of previously formed $Co_2O_3$ and $Co_3O_4$. It followed that there was significantly less porosity caused by the conversion of $Co_2O_3$ and $Co_3O_4$ to CoO than in Example 1b and in Example 1c.

Such an oxidised cobalt sample has a significantly higher density than the samples of Examples 1a and 1b, and is substantially crack-free. This oxidised cobalt constitutes a preferred material for making an improved aluminium electrowinning anode according to the invention.

COMPARATIVE EXAMPLE 2

Overpotential Testing

An anode made of metallic cobalt oxidised under the conditions of Comparative Example 1 was tested in an aluminium electrowinning cell.

The cell's electrolyte was at a temperature of 925° C. and made of 11 wt % $AlF_3$, 4 wt % $CaF_2$, 7 wt % KF and 9.6 wt % $Al_2O_3$, the balance being $Na_3AlF_6$.

The anode was placed in the cell's electrolyte at a distance of 4 cm from a facing cathode. An electrolysis current of 7.3 A was passed from the anode to the cathode at an anodic current density of 0.8 A/cm$^2$.

The electrolysis current was varied between 4 and 10 A and the corresponding cell voltage measured to estimate the oxygen overpotential at the anode.

By extrapolating the cell's potential at a zero electrolysis current, it was found that the oxygen overpotential at the anode was of 0.88 V.

EXAMPLE 2

Overpotential Testing

A test was carried out under the conditions of Comparative Example 2 with two anodes made of metallic cobalt oxidised under the conditions of Example 1c and 1d, respectively. The estimated oxygen overpotential for these anodes were at 0.22 V and 0.21 V, respectively, i.e. about 75% lower than in Comparative Example 2.

It follows that the use of metallic cobalt covered with an integral layer of CoO instead of $Co_2O_3$ and $Co_3O_4$ as an aluminium electrowinning anode material according to the invention leads to a significant saving of energy.

COMPARATIVE EXAMPLE 3

Aluminium Electrowinning

Another anode made of metallic cobalt oxidised under the conditions of Comparative Example 1, i.e. resulting in a $Co_2O_3$ and $Co_3O_4$ integral surface layer, was tested in an aluminium electrowinning cell. The cell's electrolyte was at 925° C. and had the same composition as in Comparative Example 2. A nominal electrolysis current of 7.3 A was passed from the anode to the cathode at an anodic current density of 0.8 A/cm$^2$.

The cell voltage at start-up was above 20 V and dropped to 5.6 V after about 30 seconds. During the initial 5 hours, the cell voltage fluctuated about 5.6 V between 4.8 and 6.4 V with short peaks above 8 V. After this initial period, the cell voltage stabilised at 4.0-4.2 V.

Throughout electrolysis, fresh alumina was fed to the electrolyte to compensate for the electrolysed alumina.

After 100 hours electrolysis, the anode was removed from the cell, allowed to cool down to room temperature and examined.

The anode's diameter had increased from 1.94 to 1.97 cm. The anode's metallic part had been heavily oxidised. The thickness of the integral oxide scale had increased from 350 micron to about 1.1-1.5 mm. The oxide scale was made of: a 300-400 micron thick outer layer containing pores having a size of 30-50 micron and having cracks; a 1-1.1 mm thick inner layer that had been formed during electrolysis. The inner layer was porous and contained electrolyte under the cracks of the outer layer.

EXAMPLE 3

Aluminium Electrowinning

An anode made of metallic cobalt oxidised under the conditions of Example 1c, i.e. resulting in a CoO integral surface layer was tested in an aluminium electrowinning cell under the conditions of Comparative Example 3. A nominal electrolysis current of 7.3 A was passed from the anode to the cathode at an anodic current density of 0.8 A/cm$^2$.

At start-up the cell voltage was at 4.1 V and steadily decreased to 3.7-3.8 V after 30 minutes (instead of 4-4.2 in Comparative Example 3). The cell voltage stabilised at this level throughout the test without noticeable fluctuations, unlike in Comparative Example 3.

After 100 hours electrolysis, the anode was removed from the cell, allowed to cool down to room temperature and examined.

The anode's external diameter did not change during electrolysis and remained at 1.94 cm. The metallic cobalt inner part underneath the oxide scale had slightly decreased from 1.85 to 1.78 cm. The thickness of the cobalt oxide scale had increased from 0.3 to 0.7-0.8 mm (instead of 1-1.1 mm of Comparative Example 3) and was made of: a non-porous 300-400 micron thick external layer; and a porous 400 micron thick internal layer that had been formed during electrolysis. This internal oxide growth (400 micron thickness over 100 hours) was much less than the growth observed in Comparative example 3 (1-1.1 mm thickness over 100 hours).

It follows that the anode's CoO integral surface layer inhibits its diffusion of oxygen and oxidation of the underlying metallic cobalt, compared to the $Co_2O_3$ and $Co_3O_4$ integral surface layer of the anode of Comparative Example 3.

Variation

The anode material of Examples 1a to 1d, 2 and 3 can be covered upon formation of the integral CoO layer with a slurry applied layer, in particular containing $CoFe_2O_4$ particulate in a iron hydroxide colloid followed by drying at 250° C. to form a protective layer on the CoO integral layer.

The invention claimed is:

1. In a cell for electrowinning aluminium, the cell containing a molten electrolyte in which alumina is dissolved, an anode that is in contact with the molten electrolyte for electrowinning aluminium from the alumina dissolved in the molten electrolyte, said anode comprising a cobalt-containing metallic outwardly-facing part that is covered with an integral oxide layer containing predominantly cobalt oxide CoO, the integral oxide layer being obtainable by subjecting the cobalt-containing metallic outwardly-facing part to an oxidation treatment at a temperature of at least 895° C. to form from the cobalt-containing metallic outwardly-facing part said integral oxide layer containing predominantly CoO.

2. The anode of claim 1, wherein the integral oxide layer has an open porosity of up to 12%, in particular up to 7%.

3. The anode of claim 1, wherein the integral oxide layer has an average pore size below 7 micron, in particular below 4 micron.

4. The anode of claim 1, wherein the metallic outwardly-facing part contains:

at least one of nickel, tungsten, molybdenum, tantalum and niobium in a total amount of 5 to 30 wt %, in particular 10 to 20 wt %, said nickel, when present, being contained in the metallic outer part in an amount of up to 20 weight % of the metallic outer part, in particular 5 to 15 weight %; and one or more further elements and compounds in a total amount of up to 5 wt %, the balance being cobalt.

5. The anode of claim 1, wherein the metallic outwardly-facing part contains cobalt in an amount of at least 95 wt %, in particular more than 97 wt % or 99 wt %.

6. The anode of claim 1, wherein the metallic outwardly-facing part contains a total amount of 0.1 to 2 wt % of at least one additive selected from silicon, manganese, tantalum and aluminium, in particular 0.1 to 1 wt %.

7. The anode of claim 1, wherein the integral oxide layer contains cobalt oxide CoO in an amount of at least 80 wt %, in particular more than 90 wt % or 95 wt %.

8. The anode of claim 1, wherein the integral oxide layer is substantially free of $Co_2O_3$ and substantially free of $Co_3O_4$.

9. The anode of claim 1, wherein the integral oxide layer is electrochemically active for the oxidation of oxygen ions and is uncovered or is covered with an electrolyte-pervious layer.

10. The anode of claim 1, wherein the integral oxide layer is covered with an applied protective layer, in particular an applied oxide layer.

11. The anode of claim 10, wherein the applied protective layer contains cobalt oxide.

12. The anode of claim 10, wherein the applied protective layer contains iron oxide.

13. The anode of claim 12, wherein the applied protective layer contains oxides of cobalt and of iron, in particular cobalt ferrite.

14. The anode of claim 10, wherein the protective layer contains a cerium compound, in particular cerium oxyfluoride.

15. The anode of claim 10, wherein the applied protective layer is electrochemically active for the oxidation of oxygen ions and is uncovered or is covered with an electrolyte pervious-layer.

16. The anode of claim 1, which has an electrochemically active surface that contains at least one dopant, in particular at least one dopant selected from iridium, palladium, platinum, rhodium, ruthenium, silicon, tantalum, tin or zinc metals, Mischmetal and their oxides and metals of the Lanthanide series as well as mixtures and compounds thereof, in particular oxides.

17. The anode of claim 16, wherein the electrochemically active surface contains a total amount of 0.1 to 5 wt % of the dopant(s), in particular 1 to 4 wt %.

18. A method of manufacturing an anode as defined claim 1, comprising:

providing an anode body having a cobalt-containing metallic outer-facing part; and subjecting the outer part to an oxidation treatment at a temperature of at least 895° C. to form an integral oxide layer containing predominantly CoO on the outer part, and contacting the anode with the molten electrolyte.

19. The method of claim 18, wherein the oxidation treatment is carried out in an oxygen containing atmosphere, such as air.

20. The method of claim 18, wherein the oxidation treatment is carried out at an oxidation temperature above 895° C. or 920° C., preferably above 940° C., in particular within the range of 950 to 1050° C.

21. The method of claim 20, wherein the metallic outer-facing part is heated from room temperature to said oxidation temperature at a rate of at least 300° C./hour, in particular at least 450° C./hour, for example by being placed in an environment, in particular in an oven, that is preheated at said oxidation temperature.

22. The method of claim 20, wherein the oxidation treatment at said oxidation temperature is carried out for more than 8 or 12 hours, in particular from 16 to 48 hours.

23. The method of claim 18, wherein the outer part is further oxidised during use.

24. The anode of claim 1, in said cell wherein the electrolyte is at a temperature below 960° C., in particular in the range from 910° to 940° C.

25. A method of electrowinning aluminium using an anode in a cell as defined in claim 1, said method comprising passing an electrolysis current via the anode through the electrolyte to produce oxygen on the anode and aluminium cathodically by electrolysing the dissolved alumina contained in the electrolyte.

26. The method of claim 25, wherein oxygen ions are oxidised on the anode's integral oxide layer that contains predominantly cobalt oxide CoO.

27. The method of claim 25, wherein oxygen ions are oxidised on an active layer applied to the anode's integral oxide layer that contains predominantly cobalt oxide CoO, said integral oxide layer inhibiting oxidation and/or corrosion of the anode's metallic outer-facing part.

* * * * *